United States Patent [19]

Damron

[11] 4,051,612

[45] Oct. 4, 1977

[54] SAFETY TOE SHIELD

[76] Inventor: Wilbur T. Damron, 4502 Lela Ave., NE., Roanoke, Va. 24019

[21] Appl. No.: 751,752

[22] Filed: Dec. 17, 1976

[51] Int. Cl.[2] ..... A43B 13/22

[52] U.S. Cl. ..... 36/72 R

[58] Field of Search ..... 36/72 R

[56] References Cited

U.S. PATENT DOCUMENTS

| | | | |
|---|---|---|---|
| 1,023,417 | 4/1912 | DeVore | 36/72 R |
| 1,884,276 | 10/1932 | Sankey | 36/72 R |
| 2,091,223 | 8/1937 | Binder | 36/72 R |
| 2,334,474 | 11/1943 | Chertok | 36/72 R |
| 2,625,753 | 1/1953 | Null et al. | 36/72 R |
| 2,927,384 | 3/1960 | Duffy | 36/72 R |
| 3,045,367 | 7/1962 | McKeon | 36/72 R |

FOREIGN PATENT DOCUMENTS

| | | | |
|---|---|---|---|
| 1,041,625 | 6/1953 | France | 36/72 R |

*Primary Examiner*—Alfred R. Guest

*Attorney, Agent, or Firm*—Shoemaker and Mattare Ltd.

[57] ABSTRACT

A safety toe shield for a shoe. The shield is easily positioned on a shoe and can be easily disengaged therefrom without marring or mutilating the shoe. The shield includes means for slidably engaging the shoe sole and catch means for locking the shield onto the shoe. The catch is positioned and has means to engage the shoe so that one size and style shield fits all sizes of both men's and women's shoes. The shield can be sized to cover essentially all of, or only a part of, the toe section of a shoe.

15 Claims, 4 Drawing Figures

SAFETY TOE SHIELD

BACKGROUND OF THE INVENTION

This invention relates generally to footwear, and more particularly, to protective footwear.

Many companies have areas which contain equipment and the like which present hazards to the people in the vicinity of that equipment. Accordingly, those people in the hazardous areas are required to wear safety, or protective, clothing. Such protective clothing includes hard hats, protective glasses, ear protection, and the like. A common item of protective clothing is a shoe safety shield. Such shields protect the wearer's foot and toes.

These protective shoes are worn at all times by those who spend much of their time in the hazardous areas. Such shoes are well known and the art contains many examples of protective shoes.

However, many employees spend only a few minutes, or a part, of their workday in such hazardous areas. It is common for such employees to wear their regular dress, or street, shoes into such areas, as they do not want to spend the time changing shoes when they are in such areas for only a short period of time. Those same employees will assiduously wear protective glasses, earplugs and/or hard hats. However, due to the inconvenience of changing shoes, they will leave their feet unprotected.

Therefore, there is need for a shoe guard which can be easily placed over a street or dress shoe without marring that shoe. Heretofore, protective shields mar, or in some manner, mutilate the shoe. For example, some shields have holding fingers which are inserted into the shoe sole, thereby mutilating the shoe. Such protective shields will not be conducive to wear on dress shoes.

Accordingly, the present invention is embodied in a protective shoe shield which can be used without marring the shoe.

SUMMARY OF THE INVENTION

The toe guard embodying the present invention is easily engaged on a shoe and will not mar that shoe. One size and style toe guard can be used in conjunction with both men's and women's shoes and fits all sizes.

The toe guard comprises a body which serves as the shield and fits over the top of the shoe. The body is sized so that virtually all widths of shoe can be accommodated. A plurality of jaws depend from the body and have planar shoulders on the lower ends thereof. The shoulders are presented inwardly of the shield and fit against the bottom of the shoe outer sole. These shoulders are extended far enough so that even the narrowest of shoe widths will be contacted.

A pair of quick catches are attained to the body and have a multiplicity of teeth thereon. The teeth mesh with the stitching of the shoe to seat the shield on the shoe. A lever is operated to engage the teeth with the shoe stitching and thereby forces the shoe bottom sole against the jaw shoulders.

The teeth on the quick catches are oriented at different angles, and the catches are pivotally connected to the shield at pivot points offset from the center of the catch so that various sized shoes can be accommodated by simply turning the lever to a greater or lesser degree about the pivot point.

Therefore, as the shoe guard is easily donned, one is encouraged to wear it. Furthermore, as there is no danger of marring the wearer's shoes, one will not hesitate to wear the toe guard. Thus, the shoe or toe guard embodying the present invention is as easily used as a protective hat, and will, therefore, be worn by those people who do not except to spend their entire working day in a hazardous area, or by one who simply wants to wear his street shoes at work in such an area.

The shoe guard is also cheaper than regular work shoes, thereby further encouraging the use of such a protective device, as one could be kept in a worker's desk or locker and used any time a hazardous area is to be entered.

OBJECTS OF THE INVENTION

It is, therefore, a main object of the present invention to provide a protective shield which is removable from a wearer's shoe.

It is yet another object of the present invention to provide a protective shield which will not mar a shoe.

It is yet another object of the present invention to provide a protective shield which fits both men's and women's shoes.

It is still another object of the present invention to provide a protective shield which can accommodate all sizes of shoes.

It is a further object of the present invention to provide a protective shield which is easily positioned and removed from a shoe.

DETAILED DESCRIPTION OF THE PREFERRED EMBODIMENT

Figure 1:
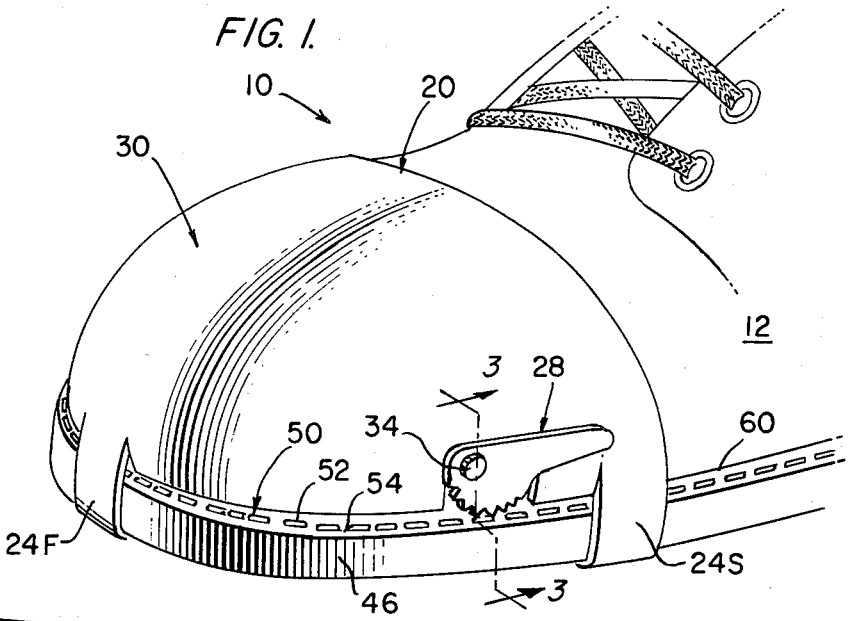
FIG. 1 is a perspective view of a shoe having thereon a toe guard embodying the teachings of the present invention.

Shown in FIG. 1 is a vamp 10 of a shoe 12. The shoe 12 can be any style, men's or women's, shoe, and can be either a dress shoe or a work shoe, and can be of any size.

Also shown in FIG. 1 is a toe shield 20 superposed on top of the shoe to protect the wearer's toes in areas where heavy objects or the like may fall on a worker's feet. The shield 20 is integral and formed of a material which will afford sufficient protection to a wearer. Materials commonly used in shoe toe plates are suitable.

The unitary toe shield comprises a plurality of integral retaining jaws, including side jaws 24S and forejaw 24F, and a pair of quick-catches 28 each pivotally attached to body 30 of the toe shield by an attaching means, such as rivet 34.

The retaining jaws each are elongate and have one end thereof integral with the toe shield body 30 and depend therefrom. The jaws each are bowed outwardly of the body 30 and terminate in a planar shoulder 38 presented inwardly of the toe shield body 30. The jaws extend beneath lower marginal edge 40 of the toe shield body 30 and the spacing between edge 40 and shoulder 38 is sufficient to receive shoe sole 46 is free sliding engagement therebetween, so that the toe shield can snugly fit over the toe section of the shoe 12 shown in FIG. 1 to protect a wearer's toes. The shoe sole 46 has the usual stitching 50 with projecting cord 52 and flats 54. The sole intersects the vamp at intersection 60 where it is attached to inner sole 62 as by adhesive means 64 or the like.

Figure 2:
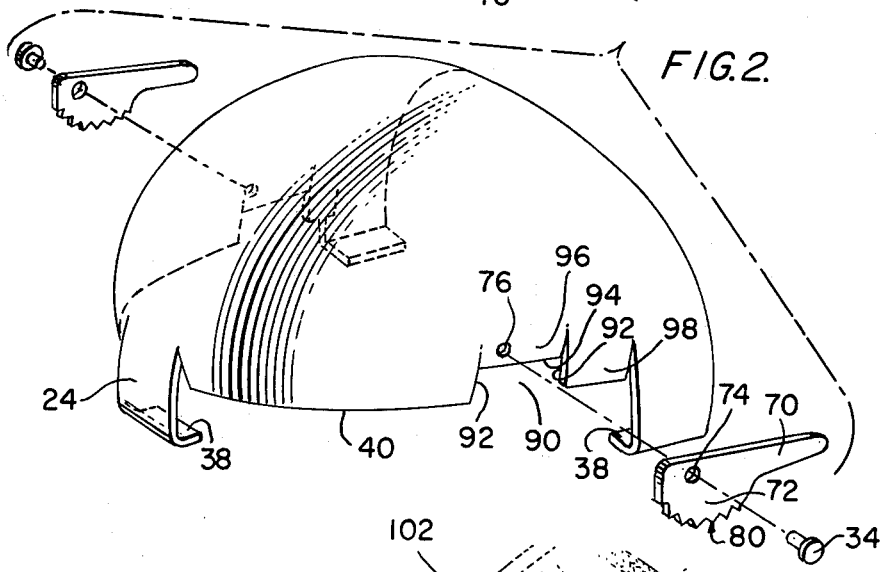
FIG. 2 is an exploded view of a toe guard embodying the teachings of the present invention.
Figure 3:
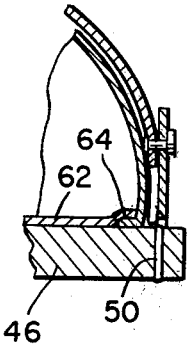
FIG. 3 is an elevation view taken along line 3—3 of FIG. 1.

Referring to FIG. 2, each quick-catch 28 includes a handle 70 integral with an arcuate detent body 72 having defined therein a rivet receiving hole 74 which is offset from the center of the body to be located near an upper edge thereof. Rivets 34 are received in holes 74 and are each locked into a cooperating hole 76 defined in body 30 of the shield. Teeth 80 are defined on the outer peripheral edge of the detent body to engage stitching 50 of the shoe.

As shown in FIG. 2, the teeth are of uneven size and are formed to project radially outward at various angles with respect to the periphery of the catch body. The multiplicity of sizes and angles defined by the ratchet permits one size toe cap to fit many sizes of shoes. Thus, large shoes might be accommodated using those teeth positioned in the front of the body, while smaller shoes have the stitching thereof in registry with the teeth located closest to the handle 70 of the catch 28. The angle and size of the teeth, in cooperation with the offset nature of the holes 74 and 76, therefore permits the toe shield to accommodate virtually all sizes and styles of shoes.

Thus, the teeth shown in the Figures have an irregular appearance because of the various sizes and angles at which they are oriented.

Also shown in FIG. 2 is gap 90 defined by spaced depending lips 92 and offset edge 94 of the body 30. The body of the quick-catch is located adjacent gap 90 to permit free movement of the catch while still insuring a firm, reliable meshed engagement between the ratchet teeth 80 and stitching 50 of the shoe. As shown in FIG. 2, segment 96 of the body 30 is generally planar, which tab 98 located between segment 96 and the side retaining jaw 24S is slightly bowed outwardly. The forces exerted on the detent body are thus transmitted to body 30 via rivets 34 along a path arranged to efficiently accommodate such forces.

Figure 4:
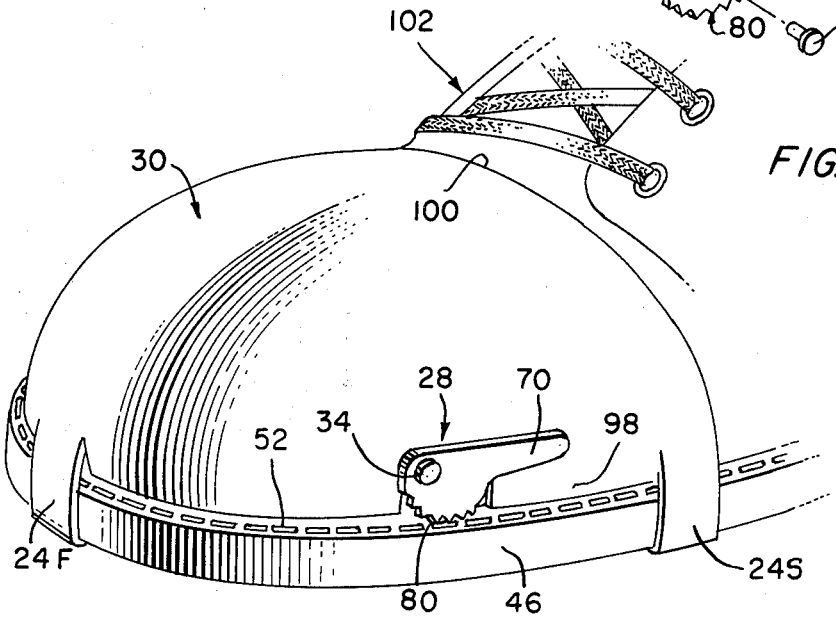
FIG. 4 is a perspective view of another embodiment of the present invention.

As shown in FIG. 4, the toe shield can be extended to cover a major portion of the shoe toe section, so that aft edge 100 is located closely adjacent shoe laces section 102.

Thus, a single sized toe shield is easily accommodated on any shoe size, and a single shield can be used in conjunction with either men's or women's shoes, as well as all sizes of either type of shoe. The shield is simply slipped onto the shoe with the sole slidingly introduced into side jaws 24S until forejaw 24F is engaged with the forepart of the shoe. The handles of the catches 28 are depressed until appropriate ones of the teeth 80 engage with the stitching 50 to draw the shield down onto the shoe and seat that shield firmly in place. Once locked, the angles of the teeth, and the offset nature of the pivot point, will keep the catch locked until the handle is forced upwardly. Thus, the shield will remain the place during normal wear. The toe shield is thus just as simple to use as a protective hat, and people will therefore be equally as encouraged to use protective toe shields as they are protective hats. As one size fits all, an entire office staff can be accommodated with only a few pairs of such toe shields, thereby encouraging the use thereof.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A safety toe shield for use on a shoe comprising:

a body having a lower marginal edge and adapted to be placed over and over the toe of a shoe;

a plurality of jaws depending from said body and each having a shoulder thereon which will engage the bottom of the sole of the shoe;

a plurality of quick-catches pivotally mounted on the body to engage the top of the shoe sole and force said shoulders into engagement with the shoe sole bottom; and means on said quick-catches for locking said quick latches against the shoe sole to thereby lock said body onto said shoe without marring the shoe.

2. The safety toe shield defined in claim 1, including a pair of quick-catches.

3. The safety toe shield defined in claim 1, wherein said quick-catches each include teeth located at various angles on said quick-catches.

4. The safety toe shield of claim 3, wherein said ratchet teeth are of different sizes.

5. The safety toe shield defined in claim 1, wherein said jaws are bowed outwardly of said body.

6. The safety toe shield defined in claim 1, wherein said quick-catches are each pivotally attached to said body at pivot points which are offset from the center of said quick-catches.

7. The safety toe shield defined in claim 1, wherein said jaws include a forejaw and side jaws.

8. The safety toe shield defined in claim 1, wherein said jaw shoulders are all essentially co-planar.

9. The safety toe shield defined in claim 1, wherein said body has an aft edge located near the laces section of the shoe.

10. The safety toe shield defined in claim 1, wherein said body has an aft edge spaced apart from the laces section of the shoe.

11. The safety toe shield defined in claim 1, wherein said body comprises impact resistant material.

12. The safety toe shield defined in claim 1, wherein said jaws are integral with said body.

13. The safety toe shield defined in claim 1, wherein said body is generally curved and includes planar sections and said catches are attached to said planar sections.

14. The safety toe shield defined in claim 1, wherein said body has defined therein cutout sectors, and said catches are located adjacent said cutout sectors.

15. The safety toe shield defined in claim 14, wherein said body further includes a tab section located between said cutout sectors and said jaws.

* * * * *